US005842798A

United States Patent [19]

Su

[11] Patent Number: 5,842,798

[45] Date of Patent: Dec. 1, 1998

[54] COMPUTER KEY

[75] Inventor: Tsui-Jong Su, Taipei Hsien, Taiwan

[73] Assignee: Shin Jiuh Corp., Taipei Hsien, Taiwan

[21] Appl. No.: 15,509

[22] Filed: Jan. 29, 1998

[30] Foreign Application Priority Data

Dec. 4, 1997 [TW] Taiwan ..... 86220228

[51] Int. Cl.[6] ..... B41J 5/08

[52] U.S. Cl. ..... 400/491.2; 400/472; 400/490

[58] Field of Search ..... 400/472, 480, 400/481, 490, 491, 491.2; 361/680; 341/23; 323/168

[56] References Cited

U.S. PATENT DOCUMENTS

| | | | |
|---|---|---|---|
| 5,268,545 | 12/1993 | Bruner | 200/345 |
| 5,602,715 | 2/1997 | Lempicki et al. | 361/680 |
| 5,621,610 | 4/1997 | Moore et al. | 361/680 |
| 5,625,532 | 4/1997 | Sellers | 361/680 |
| 5,635,928 | 6/1997 | Takagi et al. | 341/22 |

*Primary Examiner*—Edgar S. Burr
*Assistant Examiner*—Dave A. Ghatt
*Attorney, Agent, or Firm*—Finnegan, Henderson, Farabow, Garrett & Dunner, L.L.P.

[57] ABSTRACT

A computer key includes two pairs of pivotally connected linking arms disposed between a base plate and a push button. The push button has a hingeably groove defining portion that defines a hinging axis transverse to said longitudinal direction, and a second slidably retaining guideway disposed in an underside thereof. The groove defining portion includes front and rear bearing support members spaced apart from each other along the hinging axis. The front and rear bearing support members have front and rear outboard walls in the hinging axis and define a distance which is larger than that between two hooking ends of a pair of the linking arms. The front and rear outboard walls have front and rear recesses respectively to form front and rear bearing surfaces respectively transverse to the front and rear outboard walls and facing upwardly toward the underside of the push button. When the hooking ends are to be fitted into the groove defining portion, they are initially forced apart along the hinging axis, thereby permitting press fitting thereof into the front and rear recesses by slipping on the front and rear outboard walls respectively so that the hooking ends are hingeably retained on the front and rear bearing surfaces, respectively.

3 Claims, 4 Drawing Sheets

COMPUTER KEY

BACKGROUND OF THE INVENTION

1. Field of the Invention

The invention relates to a computer key, more particularly to a computer key with a push button which includes a retention groove defining portion of a novel structure at an under side thereof to provide a stable hing-type engagement to hooking ends of a respective pair of two pairs of pivotally connected linking arms that are disposed between a base plate and the push button.

2. Description of the Related Art

Referring to FIGS. 1 and 2, a conventional computer key is shown to include a base plate 40, a membrane circuit 60, a push button 11, an upright elastomeric biasing member 50, and a linking frame member 12 consisting of first and second linking frames 121, 122.

As illustrated, the base plate 40 includes a first hingeably retaining groove 401 which defines a first hinging axis, and a first slidably retaining guideway 402 spaced apart from the first hingeably retaining groove 401 in a longitudinal direction of the base plate 40 so as to define an actuation area 403 therebetween. The first hinging axis is transverse to the longitudinal direction.

The membrane circuit 60 is disposed in the actuation area 403.

The biasing member 50 includes an upper depressing portion 501 and a spacing lower portion 502 to space the upper depressing portion 501 from the actuation area and to depress the actuation area as well as a contact area of the membrane circuit 60 so as to generate an electrical signal.

The push button 11 is disposed to actuate the depressing portion 501 of the biasing member 50, and has a second hingeably retaining groove 112 that defines a second hinging axis and a second slidably retaining guideway 113 disposed in an underside thereof. The second hingeably retaining groove 112 and the second slidably retaining guideway 113 are in diagonal positions relative to the first slidably retaining guideway 402 and the first hingeably retaining groove 401 of the base plate 10, respectively.

The first linking frame 121 includes a pair of first linking arms 1211 that extend respectively in a first transverse direction relative to the first hinging axis, a first bracing member 1214 disposed between the first linking arms 1211 to space apart the same in the direction of the first hinging axis, first front and rear hooking ends 1212, 1213 which extend respectively from the first linking arms 1211 away from each other and in the same direction of the first hinging axis so as to be retained hingeably in the first hingeably retaining groove 401, and a pair of first hooking fingers 1215 which extend respectively from the first linking arms 1211 parallel to either of the first front and rear hooking ends 1212, 1213. The first hooking fingers 1215 are fitted to and are slidably retained in the second slidably retaining guideway 113.

The second linking frame 122 includes a pair of second linking arms 1221 extend respectively in a second transverse direction relative to the second hinging axis, a second bracing member 1224 disposed between the second linking arms 1221 to space apart the sane in the direction of the second hinging axis, a transverse axle 1222 interposed between the second linking arms 1221 in the direction of the second hinging axis so as to be fitted and retained hingeably in the second hingeably retaining groove 112, and a pair of second hooking fingers 1223 which extend respectively from the second linking arms 1221 parallel to the transverse axle 1222. The second hooking fingers 1223 are fitted to and are slidably retained in the first slidably retaining guideway 402.

During assembly, the first and second linking arms 1211, 1221 are pivotally connected to each other at intermediate portions thereof. Then, the front and rear hooking ends 1212, 1213 and the second hooking fingers 1223 of the first and second linking arms 1211, 1221 are inserted in the first hinegably retaining groove 401 and the first slidably retaining guideway 402 of the base plate 40 so as to be retained therein. The push button 11 is disposed on the first and second linking arms 1211, 1221 in such a manner that the transverse axle 1222 is aligned with the second hingeably retaining groove 112. A downward pressure applied on the push button 11 will force the transverse axle 1222 through a constricted gap 112*a* of the second hingeably retaining groove 112 so as to engage the transverse axle 1222 in the latter. At this time, the first hooking fingers 1215 expand outwardly away from each other in the second hinging axis so as to slip into the second slidably retaining guideway 113 of the push button 11.

It is noted that, when the downward pressure applied on the push button 11 is offset relative to the center, such as on the peripheral section of the push button 11, thereby creating an inclined pressure on the transverse axle 1222, the transverse axle 1222 will be forced to slip out of the constricted gap 112*a* and disengage the second hingeably retaining groove 112.

SUMMARY OF THE INVENTION

Therefore, the object of this invention is to provide a computer key which includes a push button with a retention groove defining portion of a unique structure to provide a stable hing-type engagement to hooking ends of a respective pair of two pairs of pivotally connected linking arms that are disposed between a base plate and the push button.

Accordingly, the computer key of this invention includes a base plate, a membrane circuit, an upright elastomeric biasing member, a push button, and a pair of pivotally connected frames consisting of first and second linking frames. The base plate includes a first hingeably retaining groove that defines a first hinging axis, and a first slidably retaining guideway spaced apart from the first hingeably retaining groove in a longitudinal direction of the base plate to define an actuation area therebetween. The first hinging axis is transverse to the longitudinal direction. The membrane circuit is disposed in the actuation area to form a contact area thereon. The upright elastomeric biasing member includes an upper depressing portion and a spacing lower portion to space the upper depressing portion from the actuation area to depress the actuation area as well as the contact area of the membrane circuit so as to generate an electrical signal. The push button is disposed to actuate the depressing portion of the biasing member, and has a hingeably retention groove defining portion that defines a second hinging axis transverse to the longitudinal direction, and a second slidably retaining guideway which are disposed in an underside thereof in diagonal positions relative to the first slidably retaining guideway and the first hingeably retaining groove of the base plate, respectively.

The first linking frame includes a pair of first linking arms 311 that extend respectively in a first transverse direction relative to the first hinging axis, a first bracing member disposed between the first linking arms to space apart the first linking arms in the direction of the first hinging axis, first front and rear hooking ends which extend respectively from the first linking arms away from each other and in the direction of the first hinging axis so as to be retained hingeably in the first hingeably retaining groove, and a pair of first hooking fingers which extend respectively from the first linking arms and parallel to either of the first front and rear hooking ends. The first hooking fingers are fitted to and are slidably retained in the second slidably retaining guideway.

The second linking frame includes a pair of second linking arms 321 that extend respectively in a second transverse direction relative to the second hinging axis, a second bracing member disposed between the second linking arms to space apart the same in the direction of the second hinging axis, second front and rear hooking ends extending respectively from the second linking arms in the direction of the second hinging axis and toward each other to define a first spaced distance therebetween, the second front and rear hooking ends being fitted and retained hingeably in the hingeably retention groove defining portion, and a pair of second hooking fingers extending respectively from the second linking arms and parallel to either of the second front and rear hooking ends. The second hooking fingers are fitted to and are slidably retained in the first slidably retaining guideway. The first and second linking arms are pivotally connected to each other at intermediate portions thereof such that the first and second linking arms confine a space to accommodate depressing movement of the biasing member when the first front and rear hooking ends, the first hooking fingers, the second front and rear hooking ends, and the second hooking fingers are received in the first hingeably retaining groove, the second slidably retaining guideway, the hingeably retention groove defining portion and the first slidably retaining guideway, respectively.

The retention groove defining portion of the push button includes front and rear bearing support members which are spaced apart from each other along the second hinging axis. The front and rear bearing support members have front and rear outboard walls in the second hinging axis. The front and rear outboard walls cooperate to define a second spaced distance which is larger than the first spaced distance. The front and rear outboard walls have front and rear recesses respectively so as to form front and rear bearing surfaces respectively transverse to the front and rear outboard walls and facing upwardly toward the underside of the push button. When the second front and rear hooking ends are to be fitted into the hingeably retention groove defining portion, they are initially forced apart along the second hinging axis, thereby permitting press fitting thereof into the front and rear recesses by slipping on the front and rear outboard walls respectively so that the second front and rear hooking ends are hingeably retained on the front and rear bearing surfaces, respectively.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
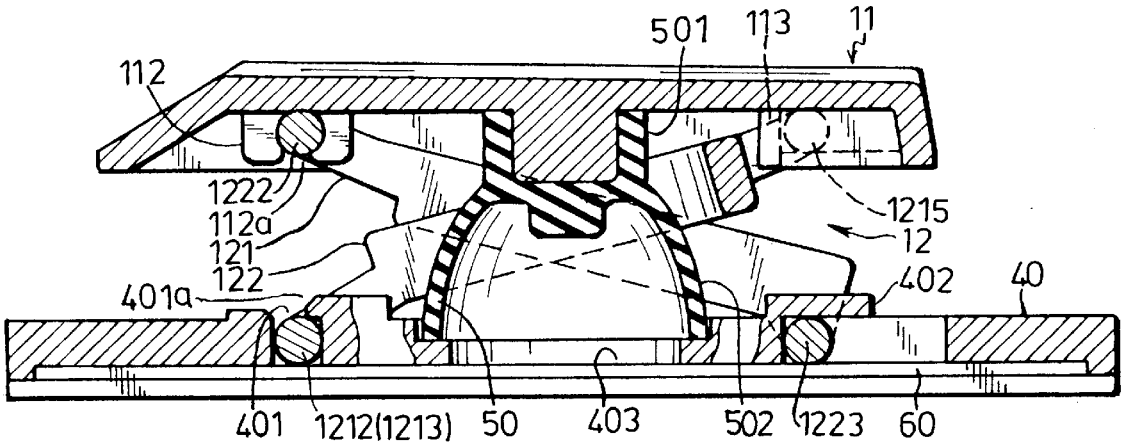
FIG. 1 PRIOR ART
FIG. 1 is a sectional view of a conventional computer key.
Figure 2:
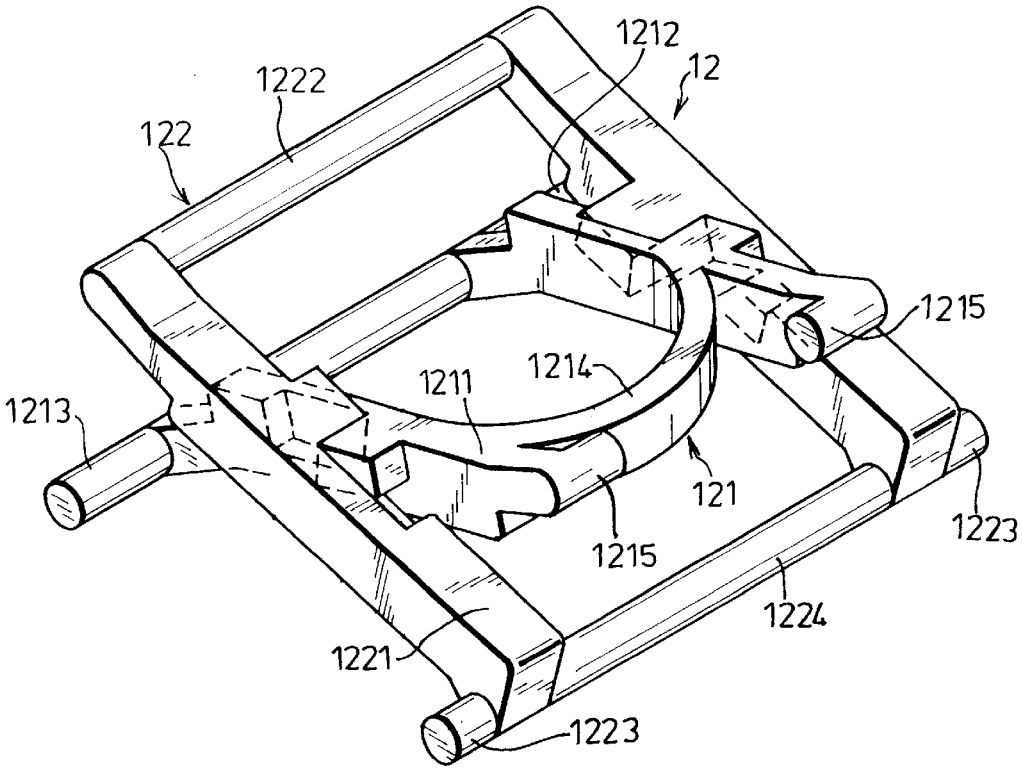
FIG. 2 PRIOR ART
FIG. 2 is a perspective view of a linking frame member employed in the conventional computer key of FIG. 1.
Figure 3:
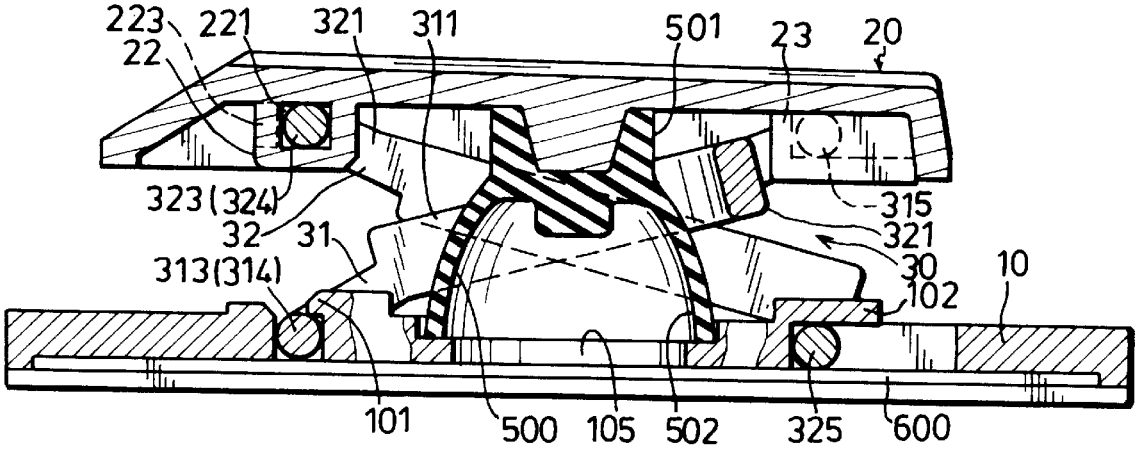
FIG. 3 is a sectional view of a preferred embodiment of a computer key according to this invention.
Figure 4:
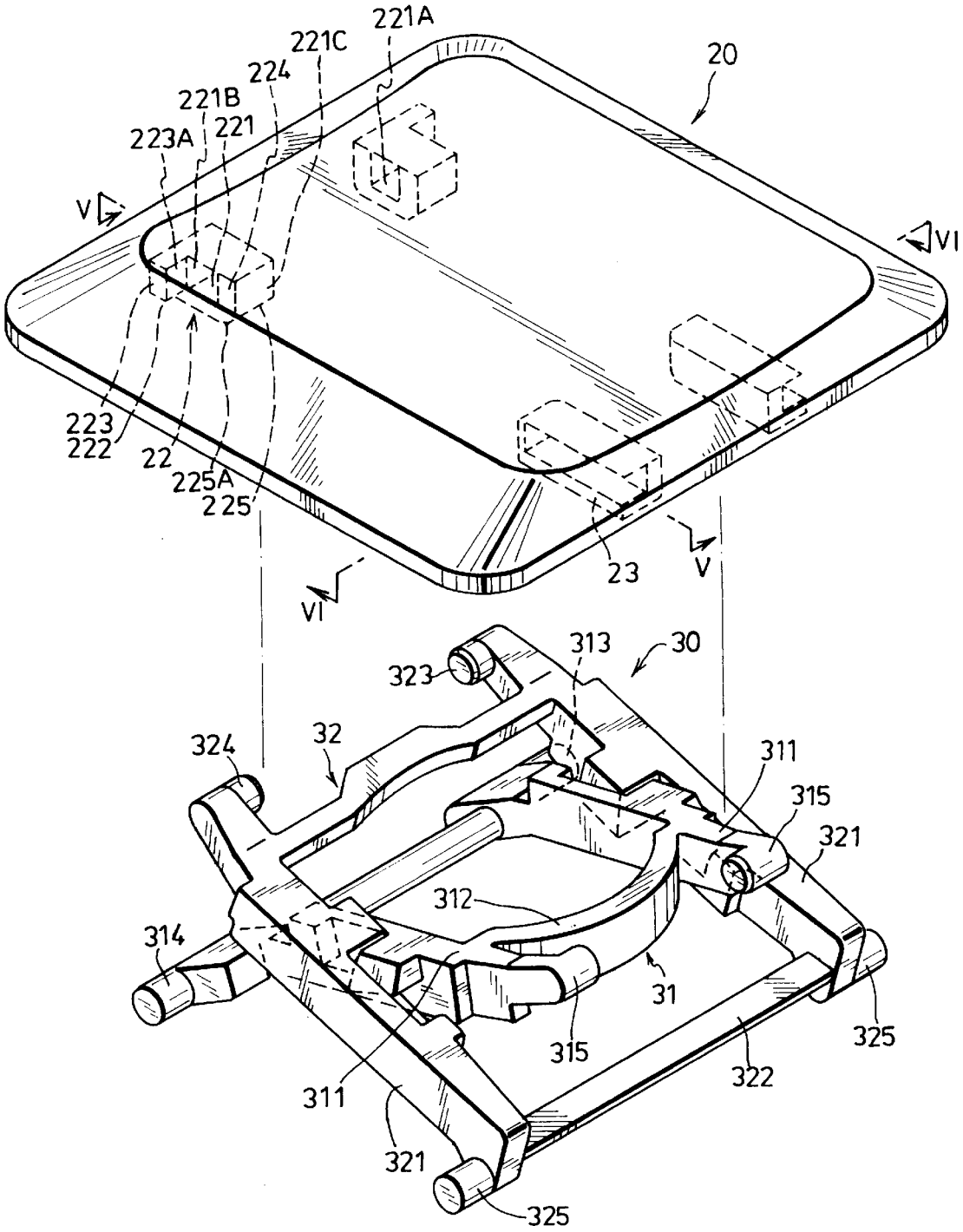
FIG. 4 is a perspective view of a push button and a linking frame member employed in the preferred embodiment.

Referring to FIGS. 3 and 4, the preferred embodiment of a computer key according to this invention is shown to include a base plate 10, a membrane circuit 600, an upright elastomeric biasing member 500, a push button 20, and a linking frame pair consisting of first and second linking frames 31, 32.

As illustrated, the base plate 10 includes a first hingeably retaining groove 101 that defines a first hinging axis, and a first slidably retaining guideway 102 that is spaced apart from the first hingeably retaining groove 101 in a longitudinal direction of the base plate 10 so as to define an actuation area 105 therebetween. The first hinging axis is transverse to the longitudinal direction.

The membrane circuit 600 is disposed in the actuation area 105 to form a contact area thereon.

The biasing member 500 includes an upper depressing portion 501 and a spacing lower portion 502 to space the upper depressing portion 501 from the actuation area 105 to depress the actuation area 105 as well as the contact area of the membrane circuit 600 so as to generate an electrical signal.

Figure 5:
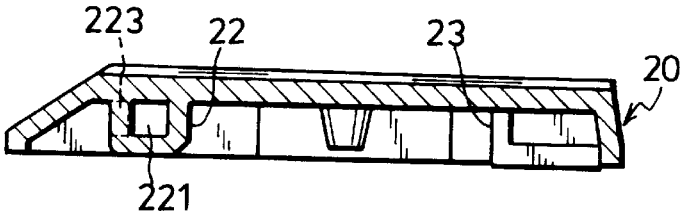
FIG. 5 is a sectional view of the push button of the preferred embodiment taken along line V—V of FIG. 4.
Figure 6:
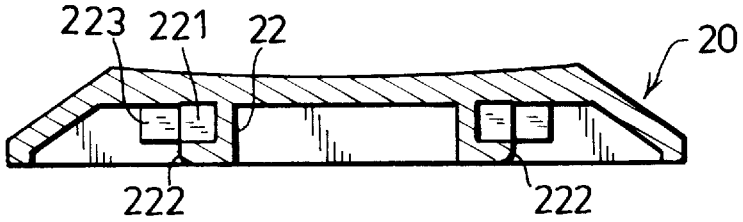
FIG. 6 is a sectional view of the push button of the preferred embodiment taken along line VI—VI of FIG. 4.

As shown in FIGS. 3, 5 and 6, the push button 20 is disposed to actuate the depressing portion 501 of the biasing member 50, and has a hingeably retention groove defining portion 22 that defines a second hinging axis transverse to the longitudinal direction, and a second slidably retaining guideway 23 disposed in an underside thereof in diagonal positions relative to the first slidably retaining guideway 102 and the first hingeably retaining groove 101 of the base plate 10, respectively.

The first linking frame 31 includes a pair of first linking arms 311 that extend respectively in a first transverse direction relative to the first hinging axis, a first bracing member 312 disposed between the first linking arms 311 to space apart the same in the direction of the first hinging axis, first front and rear hooking ends 313, 314 extending respectively from the first linking arms 311 away from each other and in the same direction of the first hinging axis so as to be retained hingeably in the first hingeably retaining groove 101, and a pair of first hooking fingers 315 that extend respectively from the first linking arms 311 and parallel to either of the first front and rear hooking ends 313, 314. The first hooking fingers 315 are fitted to and are slidably retained in the second slidably retaining guideway 23 of the push button 20.

The second linking frame 32 includes a pair of second linking arms 321 that extend respectively in a second transverse direction relative to the second hinging axis, a second bracing member 322 disposed between the second linking arms 321 to space apart the same in the direction of the second hinging axis, second front and rear hooking ends 323, 324 which extend respectively from the second linking arms 321 in the direction of the second hinging axis and toward each other to define a first spaced distance therebetween, the second front and rear hooking ends 323, 324 being fitted and retained hingeably in the hingeably retention groove defining portion 22, and a pair of second hooking fingers 325 that extend respectively from the second linking arms 321 and parallel to either of the second front and rear hooking ends 323, 324. The second hooking fingers 325 are fitted to and are slidably retained in the first slidably retaining guideway 102 of the base plate 10.

Figure 7:
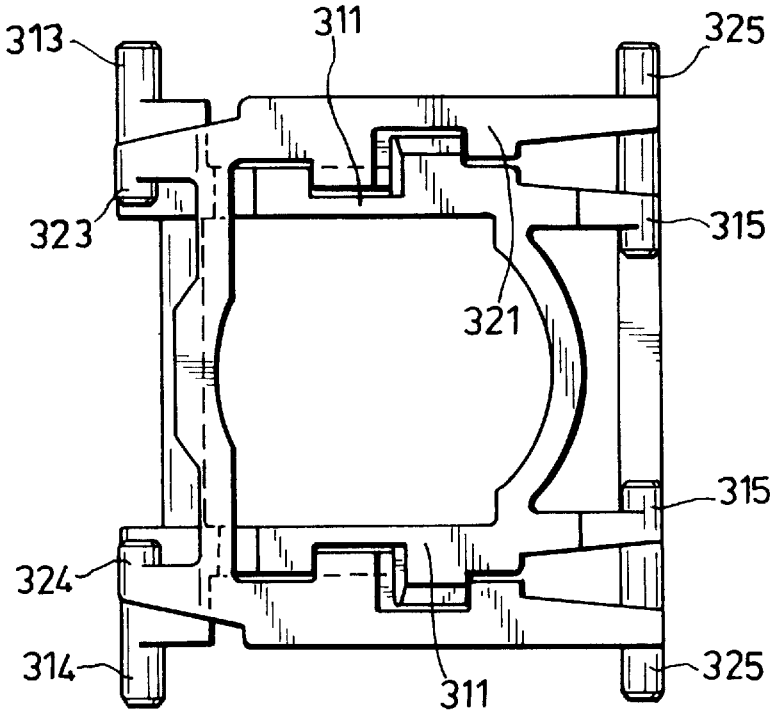
FIG. 7 illustrates how two linking frames of the frame member shown in FIG. 4 are connected pivotally to each other before attachment between a base plate and the push button of the preferred embodiment.

Referring to FIG. 7, the first and second linking arms 311, 321 are pivotally connected to each other at intermediate portions thereof such that the first and second linking arms 311, 321 confine a space to accommodate depressing movement of the biasing member 500 (see FIG. 3) when the first front and rear hooking ends 313, 314, the first hooking fingers 315, the second front and rear hooking ends 323, 324, and the second hooking fingers 325 are received in the first hingeably retaining groove 101, the second slidably retaining guideway 23, the hingeably retention groove defining portion 22 (see FIG. 3) and the first slidably retaining guideway 102 (see FIG. 3), respectively.

Referring again to FIG. 4, the hingeably retention groove defining portion 22 of the push button 20 includes front and rear bearing support members 222 that are spaced apart from each other along the second hinging axis. The front and rear bearing support members 222 have front and rear outboard walls 224 in the second hinging axis and define a second spaced distance larger than the first spaced distance. The front and rear outboard walls 224 have front and rear recesses 221 so as to form front and rear bearing surfaces 221A. The front and rear bearing surfaces 221A are transverse to the front and rear outboard walls 224 respectively and face upwardly toward the underside of the push button 20. When the second front and rear hooking ends 323, 324 of the second linking arms 321 are to be fitted into the hingeably retention groove defining portion 22, they are initially forced apart in the second hinging axis, thereby permitting press fitting of the hooking ends 323, 324 into the front and rear recesses 221 by slipping on the front and rear outboard walls 224 respectively so that the second front and rear hooking ends 323, 324 are hingeably retained on the front and rear bearing surfaces 221A respectively.

The front and rear bearing support members 222 respectively have front and rear bottom walls 225 that are parallel to the second hinging axis and that cooperate with the front and rear outboard walls 224 to form front and rear joining edge portions 225A, respectively. The front and rear joining edge portions 225A are rounded so as to facilitate slipping of a respective one of the second front and rear hooking ends 323, 324 into a corresponding one of the front and rear recesses 221.

Each of the front and rear recesses 221 includes a proximate wall portion 221C relative to the second slidably retaining guideway 23 and a distal wall portion 221B which are transverse to a respective one of the front and rear bearing surfaces 221A to define a respective one of the front and rear recesses 221. Each of the front and rear bearing support members 222 further includes a guide-in block member 223 that extends from and beyond the distal wall portion 221B in the second hinging axis so as to define an abutment wall 223A to further facilitate slipping of the second front and rear hooking ends 323, 324 into the front and rear recesses 221.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A computer key comprising:

a base plate including a first hingeably retaining groove that defines a first hinging axis, and a first slidably retaining guideway spaced apart from said first hingeably retaining groove in a longitudinal direction of said base plate so as to define an actuation area therebetween, wherein said first hinging axis is transverse to said longitudinal direction;

a membrane circuit disposed in said actuation area to form a contact area thereon;

an upright elastomeric biasing member including an upper depressing portion and a spacing lower portion to space said upper depressing portion from said actuation area to depress said actuation area as well as said contact area of said membrane circuit so as to generate an electrical signal;

a push button disposed to actuate said depressing portion of said biasing member, and having a hingeably retention groove defining portion that defines a second hinging axis transverse to said longitudinal direction, and a second slidably retaining guideway disposed in an underside thereof in diagonal positions relative to said first slidably retaining guideway and said first hingeably retaining groove of said base plate, respectively;

a first linking frame including:

a pair of first linking arms that extend respectively in a first transverse direction relative to said first hinging axis; a first bracing member disposed between said first linking arms to space said first linking arms apart in the direction of said first hinging axis; first front and rear hooking ends extending respectively from said first linking arms away from each other and in the direction of said first hinging axis so as to be retained hingeably in said first hingeably retaining groove; and a pair of first hooking fingers extending respectively from said first linking arms and parallel to either of said first front and rear hooking ends, said first hooking fingers being fitted to and being slidably retained in said second slidably retaining guideway; and a second linking frame including:

a pair of second linking arms that extend respectively in a second transverse direction relative to said second hinging axis; a second bracing member disposed between said second linking arms to space apart said second linking arms in the direction of said second hinging axis; second front and rear hooking ends extending respectively from said second linking arms in the direction of said second hinging axis and toward each other to define a first spaced distance therebetween, said second front and rear hooking ends being fitted and retained hingeably in said hingeably retention groove defining portion; and a pair of second hooking fingers extending respectively from said second linking arms and parallel to either of said second front and rear hooking ends, said second hooking fingers being fitted to and being slidably retained in said first slidably retaining guideway;

said first and second linking arms being pivotally connected to each other at intermediate portions thereof such that said first and second linking arms confine a space to accommodate depressing movement of said biasing member when said first front and rear hooking ends, said first hooking fingers, said second front and rear hooking ends and said second hooking fingers are received in said first hingeably retaining groove, said second slidably retaining guideway, said hingeably retention groove defining portion and said first slidably retaining guideway, respectively;

wherein said hingeably retention groove defining portion includes front and rear bearing support members spaced apart from each other along said second hinging axis, said front and rear bearing support members having front and rear outboard walls in said second hinging axis and defining therebetween a second spaced distance which is larger than said first spaced distance, said front and rear outboard walls having front and rear recesses respectively so as to form front and rear bearing surfaces respectively transverse to said front and rear outboard walls and facing upwardly toward said underside of said push button, whereby when said second front and rear hooking ends are to be fitted into said hingeably retention groove defining portion, said second front and rear hooking ends are initially forced apart along said second hinging axis, thereby permitting press fitting of said second front and rear hooking ends into said front and rear recesses by slipping on said front and rear outboard walls respectively so that said second front and rear hooking ends are hingeably retained on said front and rear bearing surfaces, respectively.

2. The computer key as defined in claim 1, wherein said front and rear bearing support members have front and rear bottom walls that are parallel to said second hinging axis and that cooperate with said front and rear outboard walls to form front and rear joining edge portions, each of said front and rear joining edge portions being rounded so as to facilitate slipping of a respective one of said second front and rear hooking ends into a corresponding one of said front and rear recesses.

3. The computer key as defined in claim 1, wherein each of said front and rear recesses includes a proximate wall portion relative to said second slidably retaining guideway and a distal wall portion which are transverse to a respective one of said front and rear bearing surfaces to define a respective one of said front and rear recesses, each of said front and rear bearing support members further including a guide-in block member extending from and beyond said distal wall portion in said second hinging axis so as to define an abutment wall to further facilitate slipping of a respective one of said second front and rear hooking ends into a corresponding one of said front and rear recesses.

* * * * *